US006395970B2

(12) United States Patent
Aoki

(10) Patent No.: US 6,395,970 B2
(45) Date of Patent: May 28, 2002

(54) AUTOMATIC MUSIC COMPOSING APPARATUS THAT COMPOSES MELODY REFLECTING MOTIF

(75) Inventor: Eiichiro Aoki, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/905,021

(22) Filed: Jul. 13, 2001

(30) Foreign Application Priority Data

Jul. 18, 2000 (JP) ..... 2000-216978

(51) Int. Cl.[7] ..... G10H 1/38; G10H 7/00
(52) U.S. Cl. ..... 84/613; 84/619
(58) Field of Search ..... 84/609.614, 634–638, 84/649–692, 666–669, 619

(56) References Cited

U.S. PATENT DOCUMENTS 5,753,843 A * 5/1998 Fay ..... 84/609
5,864,079 A * 1/1999 Matsuda ..... 84/619
6,124,543 A 9/2000 Aoki ..... 84/609
6,245,984 B1 6/2001 Aoki et al. ..... 84/611

* cited by examiner

*Primary Examiner*—Jeffrey Donels
(74) *Attorney, Agent, or Firm*—Rossi & Associates

(57) ABSTRACT

An automatic music composing apparatus comprises: a memory that stores a plurality of chord-progression data in a specific key; an input device that inputs motif melody data; a selector that selects at least one chord-progression data from the memory; a detector that detects a key of the input motif melody data; a transposer that transposes the selected chord-progression data into the detected key in accordance with relation between the detected key and the specific key; and a melody data generator that generates a melody in the detected key in accordance with the input motif melody data and the transposed chord-progression data.

13 Claims, 4 Drawing Sheets

AUTOMATIC MUSIC COMPOSING APPARATUS THAT COMPOSES MELODY REFLECTING MOTIF

BACKGROUND OF THE INVENTION

A) Field of the Invention

This invention relates to an automatic music composing apparatus that composes a melody reflecting a motif.

B) Description of the Related Art

A conventional melody generating apparatus composes a melody for a music piece by inputting motif melody and developing the input motif melody. That kind of melody generating apparatus has a chord-progression database and generates a melody for a section other than a motif section based on a chord-progression selected from the chord-progression database and the input motif melody.

A user inputs the motif melody in a key at the user's discretion to the melody generating apparatus; therefore, the key for the motif input by the user may not be agreed with the key for the chord-progression stored in the database. Storing the chord-progressions in any keys to agree with any keys input by a user needs increase of storing capacity for the chord-progression database.

SUMMARY OF THE INVENTION

It is an object of the present invention to provide an automatic music composing apparatus that can generates melodies reflecting motifs in various keys while reducing a database size.

According to one aspect of the present invention, there is provided an automatic music composing apparatus comprises: a memory that stores a plurality of chord-progression data in a specific key; an input device that inputs motif melody data; a selector that selects at least one chord-progression data from the memory; a detector that detects a key of the input motif melody data; a transposer that transposes the selected chord-progression data into the detected key in accordance with relation between the detected key and the specific key; and a melody data generator that generates a melody in the detected key in accordance with the input motif melody data and the transposed chord-progression data.

In the automatic music composing apparatus, chord-progression data in a specific key is stored in a database. The chord-progression data is selected from that database, and motif melody data (motif or motif melody) in a certain key is input. The key for the input motif melody data is detected, and the selected chord-progression data is transposed to the detected key (motif key). The melody generator generates a melody in the motif key in accordance with the input motif melody and the chord-progression transposed to the motif key. Therefore, in the chord-progression database, one set of chord-progressions in a specific key (e.g., C Major) is necessary to be stored, and melodies in the motif keys for whole composition can be generated while reducing the size of the database.

According to another aspect of the present invention, there is provided an automatic music composing apparatus, comprising: a memory that stores a plurality of chord-progression data in a specific key; an input device that inputs motif melody data; a selector that selects at least one chord-progression data from the memory; a detector that detects a key of the input motif melody data; a first transposer that transposes the input motif melody data into the specific key in accordance with relation between the detected key and the specific key; a melody data generator that generates a melody in the specific key in accordance with the transposed motif melody data and the selected chord-progression data; and a second transposer that transposes the generated melody into the detected key.

In the automatic music composing apparatus, chord-progression data in a specific key is stored in a database. The chord-progression data is selected from that database, and motif melody data (motif or motif melody) in a certain key is input. The key for the input motif melody data is detected, and the input motif is transposed to the specific key. The melody generator generates a melody in the specific key in accordance with the transposed motif melody and the selected chord-progression. After that, the generated melody is transposed to the detected motif key. Therefore, in the chord-progression database, one set of chord-progressions in a specific key (e.g., C Major) is necessary to be stored, and melodies are generated in the specific key. Melodies in the motif keys for whole composition can be easily generated while reducing the size of the database.

DETAILED DESCRIPTION OF THE PREFERRED EMBODIMENTS

Figure 1:
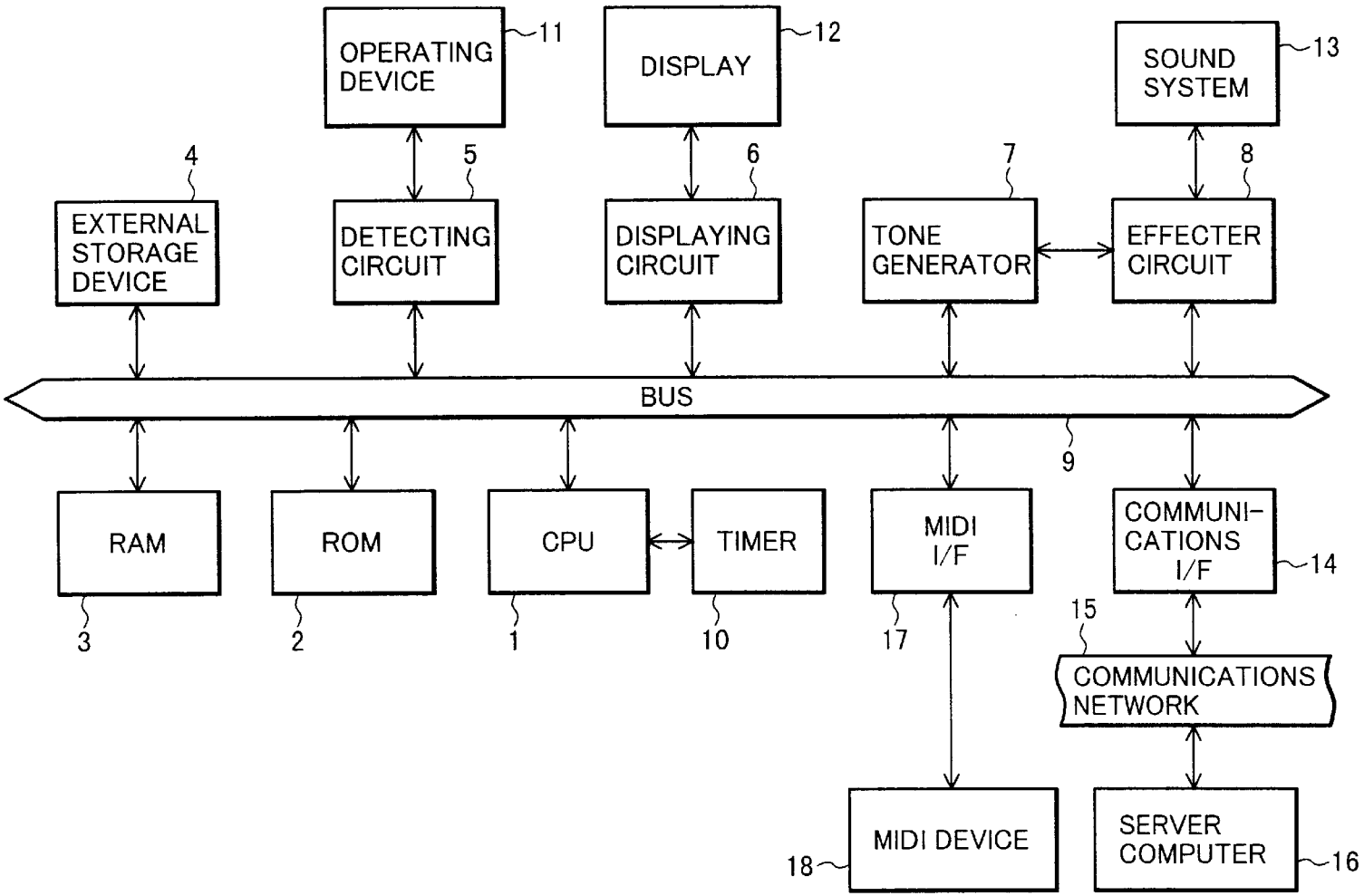
FIG. 1 is a block diagram showing a hardware structure of an automatic music composing system according to an embodiment.

FIG. 1 shows a block diagram showing a hardware structure of an automatic music composing system according to first and second embodiments. In this system, for example, various processes including melody-generating process are executed by a personal computer (PC). The system has, at least, a central processing unit (CPU) 1, a read only memory (ROM) 2, a random access memory (RAM) 3, an external storage device 4, a detecting circuit 5, displaying circuit 6, a tone generator 7, an effecter circuit 8. Those devices 1 to 8 are connected one another via a bus 9.

The CPU 1 controlling a whole system, controls various processes based on a predetermined software program at a timing of a clock signal supplied from a timer 10. For example, the CPU 1 mainly executes later-described melody generating process. The ROM 2 stores a control program for controlling the system, and a program for the melody generating process, various tables, and various data may be included in the control program together with a basic information processing code. The RAM 3 is used for storing necessary data and parameter for those processes executed by the CPU 1, and as a working area where various registers, flags and data being processed are temporally stored.

The external storage device 4 is, for example, a hard disk drive, a CD-ROM drive, a floppy disk drive, a magneto optical (MO) disk drive, digital versatile disk (DVD) drive, semi-conductor memory or the like, and can store therein various computer programs, and data, or the like. The external storage device 4 can be used as a storage area for various parameters and a chord-progression database. Therefore, the program for the melody generating process, various tables, and various data may be stored in the external storage device 4, and result of the process may be recorded therein if necessary.

The detecting circuit 5 is connected with an operating device 11. The operating device 11 has a keyboard and a pointing device such as a mouse or the like for inputting information to the system from a user. The user can use the keyboard and the pointing device as a musical keyboard or panel switches. Therefore, the user can input performance data such as motif melody in real time or step-by-step by using the operating device 11.

The displaying circuit 6 is connected with a display 12 and indicators. A cursor and software switches operated by the operating device 11 such as the pointing device or the like are displayed on the display 12. Therefore, various input operations for the melody generation such as input of the motif melody can be made by operating the software switches on the display 12 for inputting pitches and lengths of notes through the operating device 11. Besides the keyboard and the pointing device, an external performance-inputting device (e.g., piano like keyboard) and external panel switches may be connected as the operating device 11 to input various performance information and tone control information including performance data such as the motif melody.

The tone generator 7 is connected with a sound system 13 including loud speakers via the effecter circuit 8 formed of DSP or the like. The tone generator 7 can read generated melody data from the RAM 3 and reproduce musical tone corresponding to the generated melody data stored in the RAM 3.

In the embodiments, a communications interface (I/F) 14 is connected to the bus 9; therefore, the control program, various data, or the like can be downloaded from a server computer 16, other PC or mobile communication terminal device via a communications network 15 such as a local area network (LAN), the Internet, telephone line or the like and stored into the external storage device 4. Moreover, a MIDI interface (I/F) 17 is connected to the bus 9 so that the system can transmit/receive various data to/from a MIDI device connected via the MIDI I/F 17.

Although, in the embodiments, the personal computer as shown in FIG. 1 is used for the automatic music composing system, an electronic musical instrument having a music keyboard and panel switches or other devices having similar ability can be used.

Figure 2:
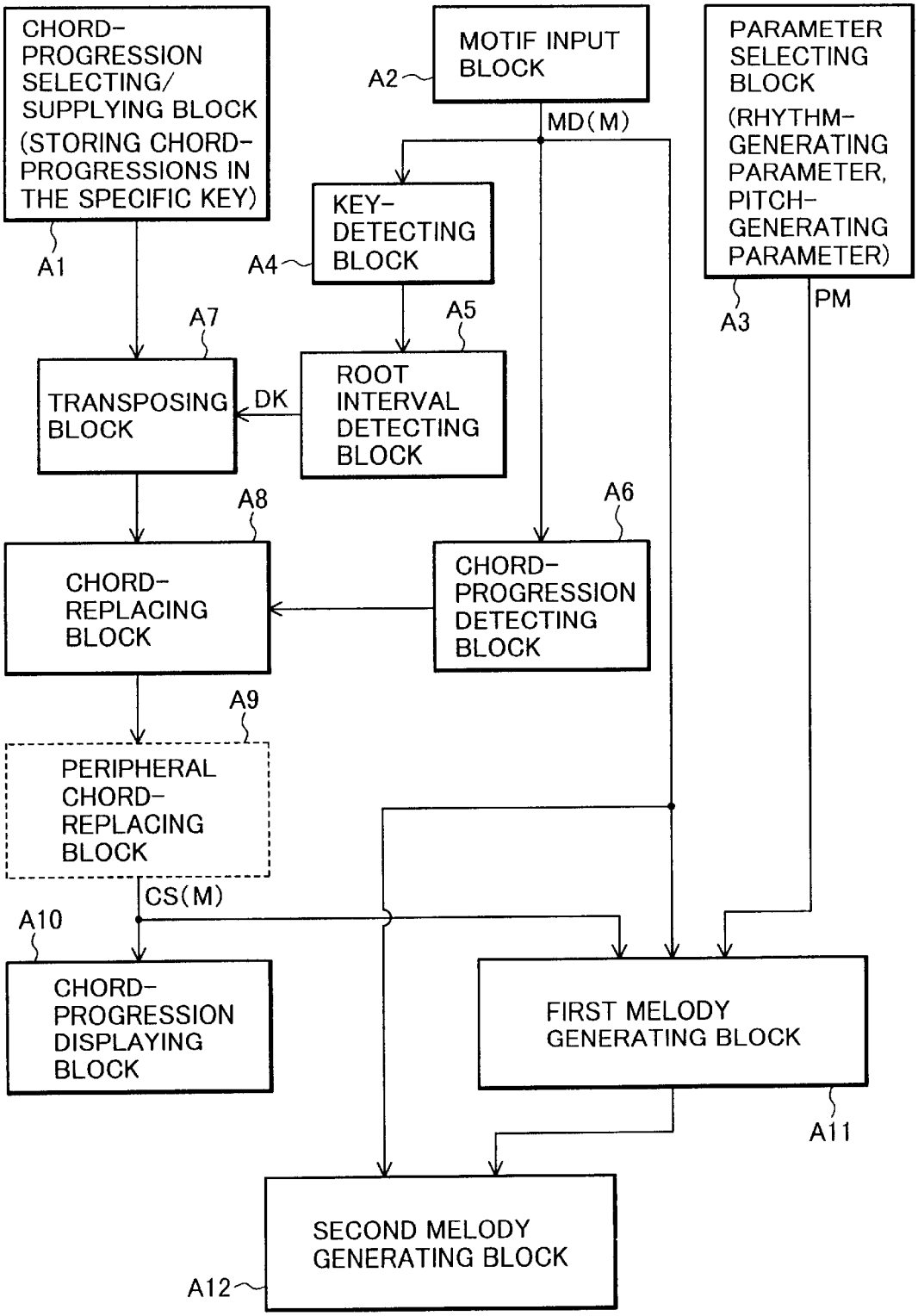
FIG. 2 is a block diagram showing a function of melody generating process according to a first embodiment of the present invention.

FIG. 2 is a block diagram showing a function of melody generating process according to the first embodiment of the present invention.

In a chord-progression selecting/supplying block A1, a predetermined chord-progression is selected from the database (chord-progression database) storing chord-progressions in a specific key, and the selected chord-progression is supplied to a transposing block A7. The chord-progression database stored in the external storage device 4 records a multiplicity of chord-progressions in one specific key (e.g., C Major), and a user can select one from the multiplicity of chord-progressions from the chord-progression database.

Each chord-progression corresponds to at least one of musical genres (e.g., pops, classical, jazz, or the like) and words or phrases expressing mood of music (e.g., mellow, hard or the like). The user may select a chord-progression by selecting the musical genre, the word or the phrases.

The chord-progressions are pre-stored (preset) in the chord-progression database and/or made and stored by a user. Also, the chord-progressions may be downloaded from the server computer 16 or the like. Further, a user can edit the chord-progressions in the chord-progression database.

In a motif input block A2, motif melody MD (M) is input by, for example, assigning one note or chord at a time with the pointing device or the like (step entry), playing motif with the operating device 11 in real-time (real-time entry), reading a pre-stored melody from the external storage device 4, downloading existing music data from the server computer 16, or receiving motif melody MD (M) from other PC or a mobile communication terminal device as an attached file of electronic mail. The input motif melody MD (M) is distributed to a key-detecting block A4, a chord-detecting block A6 and a first melody-generating block A11.

The input motif melody MD (M), as being input by a user, is not guaranteed to be in the specific key, and its chord-progression is not guaranteed to match with the selected chord-progression. Therefore, the key of the input motif melody will be detected in the later described block A4, and the chord-progression or chord of the input motif melody will be detected in the later described block A6.

In a parameter selecting block A3, a melody generating parameter PM is selected and supplied to the first melody-generating block A11. The melody generating parameter PM is consisting of a rhythm-generating parameter and a pitch-generating parameter. The melody generating parameter PM also includes a framework of passages. The rhythm-generating parameter, for example, represents one of the characteristic beat of musical rhythm, the number of notes, existence of syncopations or the likes. The pitch-generating parameter, for example, represents a key, a range, dynamics or the like.

A user can set each parameter individually or select a template of a set of parameters from pre-stored templates. Each of the pre-stored templates corresponds to at least one of musical genres (e.g., pops, classical, jazz, or the like) and words or phrases expressing mood of music (e.g., mellow, hard or the like). The user can select a template by specifying a genre, word or phrase.

The templates may be preset templates or user templates. Also, the templates may be downloaded from the server computer 16. The user can edit the preset or downloaded templates. Further, the chord-progression selected in the chord-progression selecting/supplying block Al and the melody generating parameter PM selected in the parameter-selecting block A3 may be combined in advance and selected simultaneously instead of selecting them individually.

The key-detecting block A4 detects the key (detected key) of the motif melody MD (M) input in the block A2. The key detection is executed by well-known techniques. In this block A4, a plurality of keys may be nominated, and the user may select one from the nominated keys. The detected or selected motif key (the detected key) will be supplied to a root interval-detecting block A5.

The root interval-detecting block A5 detects interval DK between a root of the detected key (the motif key) and a root of the specific key (the key of the chord-progression selected in the block A1). For example, when the motif key detected in the block A4 is "F major", and the specific key is "C Major", the root of "F major" is seven semitones below the root of "C Major"; therefore, the detected interval DK will be "−1". Besides, the root of "C Major" is five semitones above the root of "F major"; therefore, the detected interval DK can be "+5". The detected interval will be supplied to the transposing block A7.

The chord-progression detecting block A6 detects the chord-progression of the motif melody MD (M) input in the block A2. The detection of the chord-progression is executed by well-known techniques. The detection of the chord-progression is not limited to detect one chord-progression but also can detect a plurality of chord-progressions and let the user to select one from them. The detected or selected chord-progression will be supplied to a chord-replacing block A8.

The transposing block A7 transposes the chord-progression selected in the block A1 from the specific key to the detected key by shifting at the interval DK detected in the block A5. For example, provided that the key detected from the motif is "F major", and the specific key of the chord progression is "C major", the interval DK will be seven semitones below (−7); therefore, by shifting the chord progression to seven semitones below, the chord progression will be transposed to "F major." Further, in this case, by shifting the chord progression to five semitones above, the chord progression will also be transposed to "F major." The transposed chord progression will be supplied to the chord-replacing block A8.

The chord-replacing block A8 replaces a chord in a section of the transposed chord progression corresponding to the input motif with the motif chord-progression detected in the block A6. That is, the chord-progression detected in the block A6 is that of the motif melody MD (M); therefore, a section of the transposed chord-progression corresponding to the motif section is replaced with the detected motif chord-progression in this block A8. The transposed chord-progression a section of which is replaced with the motif chord progression will be supplied to a peripheral chord-replacing block A9.

The peripheral chord-replacing block A9 replaces, if necessary, peripheral chords of the motif section of the transposed chord-progression supplied from the block A8 to improve connectivity. By that replacement, the chord-progression of the motif melody MD (M) which replaced the corresponding section of the transposed chord-progression in the block A8 can be connected naturally (smoothly) with the chord-progressions before and after that. The details of the replacement of the peripheral chords are disclosed in Japanese Patent Application 2000-218107, which is incorporated herein by reference. The peripheral chord-replacing block A9 may be omitted if the replacement is not necessary.

The complete chord-progression CS (M) supplied from the block A8 or A9 will be supplied to the first melody-generating block A11. If the complete chord-progression CS (M) is supplied from the block A8, the section of the transposed chord-progression corresponding to the motif melody MD (M) has been replaced in the block A8. If the complete chord-progression CS (M) is supplied from the block A9, the section of the transposed chord-progression corresponding to the motif melody MD (M) has been replaced in the block A8, and also the peripheral chords of the section corresponding to the motif melody MD (M) have been replaced in the block A9. If necessary, a chord-progression displaying block A10 displays the complete chord-progression CS (M) on the display 12 (FIG. 1).

The first melody-generating block A11 generates a melody (or melodies) excluding the motif sections in the key of the motif melody MD (M) (the detected key) based on the complete chord-progression CS (M), the motif melody MD (M) input in the block A1 and the melody generating parameter PM selected in the block A3. The passage of the motif melody MD (M) is copied to generate a melody for a section represented with the same symbol as the motif melody MD (M). The generated melody will be supplied to the second melody-generating block A12.

For example, provided that the passage framework in the melody generating parameter PM is "A-A'-B-A" ("A" representing the motif section), the last section represented with "A" will be a copy of the motif melody MD (M). The first half of the section "A'", a variation of the section "A", will be, for example, copied from the first half of the motif melody MD (M), and the second half of the section "A'" will be created based on the pitch generating parameter and the rhythm generating parameter included in the melody generating parameter PM and the chord-progression. The section "B" (passage different from the motif melody MD (M)) will be created based on the melody generating parameter PM and the chord-progression.

The creation (or generation) of a new melody will be executed by the following sequence. First, rhythm for the new melody is generated, for example, by selecting rhythm pattern from a rhythm database which may be pre-stored in the external storage device 4 (FIG. 1) based on the rhythm generating parameter in the melody generating parameter PM. Next, notes constituting a chord in the chord-progression are randomly assigned to important beats of the rhythm (e.g., accented beat, beat hear the accented beat or long beat). Notes constituting a scale in the key or an available note scales (AVNS) at timing are randomly assigned to beats other than the important beats. Dynamics and a range of the tone should be considered at that time. Finally, a note disagreeing with the music rule, if any, will be amended, or whole melody will be regenerated until it agrees with the music rule.

The second melody-generating block A12 merges the motif melody MD (M) input in the block A2 with the melody other than the motif generated in the block A11 to complete a piece of music.

Figure 3:
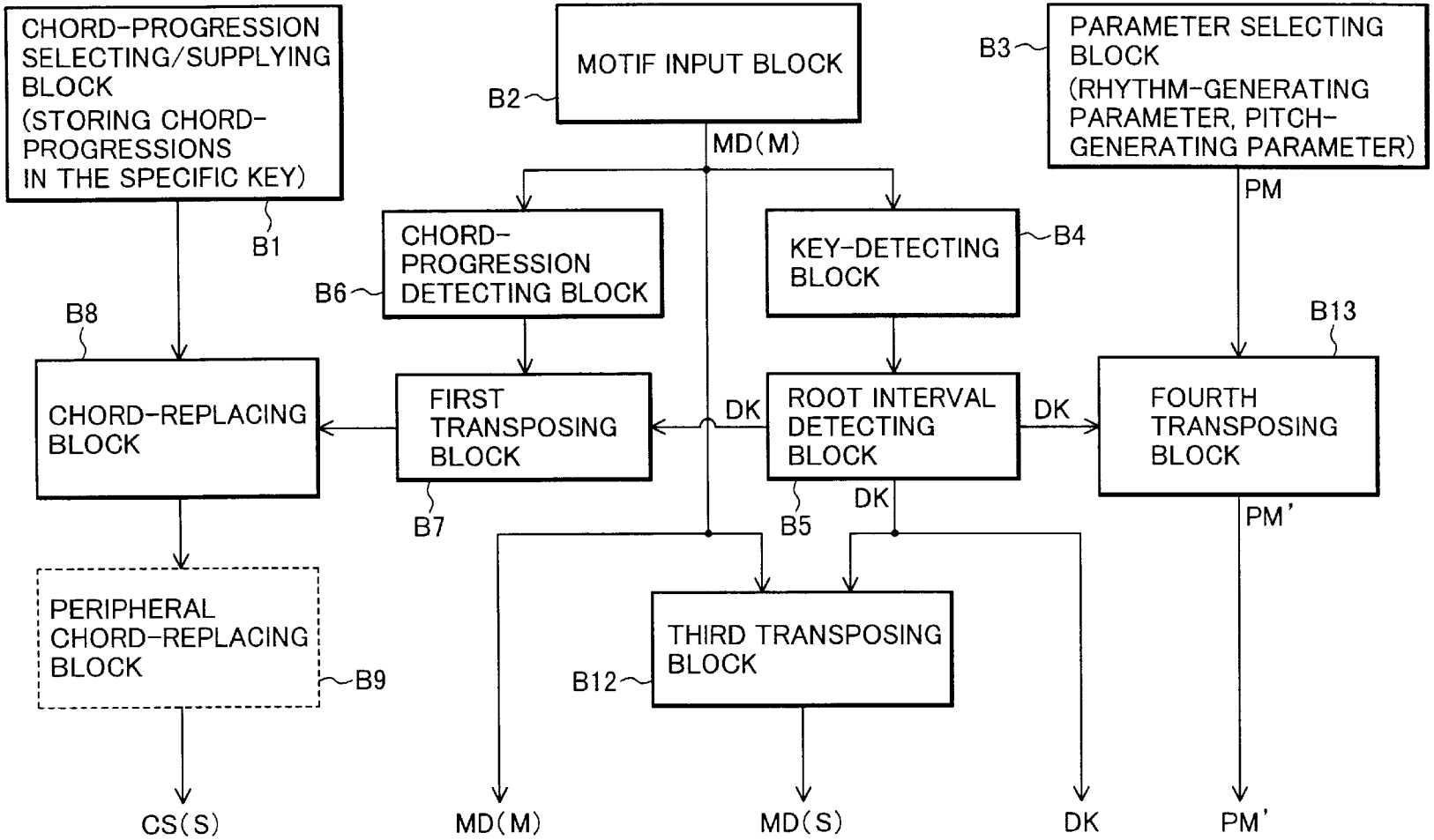
FIG. 3 is a block diagram showing a part of a function of melody generating process according to a second embodiment of the present invention.
Figure 4:
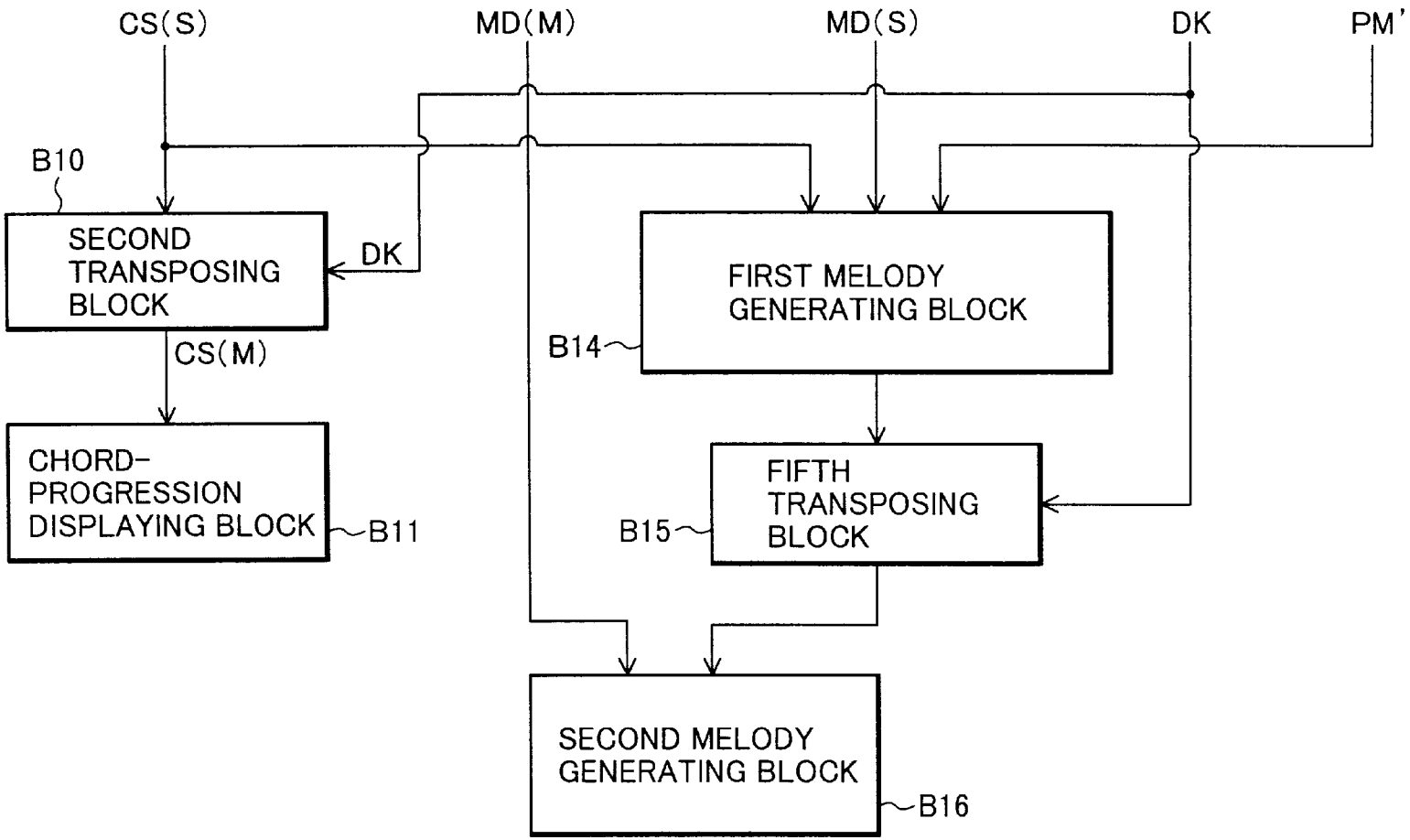
FIG. 4 is a block diagram showing another part of the function of the melody generating process according to the second embodiment of the present invention.

FIGS. 3 and 4 are block diagrams showing a function of melody generating process according to the second embodiment of the present invention.

In the second embodiment, each of blocks B1 to B6 corresponds to each of the blocks A1 to A6 of the first embodiment, and has almost similar function. That is, chord-progressions in a specific key (e.g., C Major) are stored in a chord-progression database, and a chord-progression selecting/supplying block B1 selects a chord-progression from the chord-progression database. The selected chord-progression will be used for generating a melody together with a melody generating parameter PM selected in a melody generating parameter selecting/supplying block B3.

Motif melody MD (M) is input by, for example, the step entry, the real-time entry, reading a pre-stored melody from the external storage device 4, downloading existing music data from the server computer 16 or the like.

The input motif melody MD (M), as being input by a user, is not guaranteed to be in the specific key, and its chord-progression is not guaranteed to match with the selected chord-progression. Therefore, the key of the input motif melody will be detected in a block B4 and the chord-progression thereof will be detected in a block B6. A block B5 detects an interval DK between the detected key and the specific key.

In the function blocks B1 to B3, the chord-progression, the motif melody MD (M) and the melody generating parameter PM are provided similar to the first embodiment (the blocks A1 to A3). In the function blocks B4 to B6, the interval DK between the detected key and the specific key, the chord-progression of the motif melody MD (M) are detected similar to the first embodiment (the blocks A4 to A6). Function blocks B7 to B16 in the second embodiment use the information detected in the blocks B4 to B6 to generate a melody (or melodies) for a piece of music.

A first transposing block B7 transposes the chord-progression of the motif melody MD (M) detected in the block B4 from the detected key to the specific key in accordance with the interval DK detected in the block B6. For example, the motif chord-progression in F major will be transposed to C major. When the interval DK is "−7", the motif chord-progression is shifted by negative value of the interval DK (i.e., "7"). That is, the motif chord-progression is shifted seven semitones above. To make the key of the motif chord-progression into C major, the motif chord-progression may be shifted five semitones below. The transposed motif chord-progression will be supplied to a chord-replacing block B8.

The chord-replacing block B8 replaces a chord in a section of the chord-progression selected in the block B1 corresponding to the input motif with the motif chord-progression transposed to the specific key in the block B7. Therefore, the section of the selected chord-progression corresponding to the motif section is replaced with the detected motif chord-progression in this block B8. The selected chord-progression the motif section of which is replaced with the motif chord progression will be supplied to a peripheral chord-replacing block B9.

The peripheral chord-replacing block B9 replaces, if necessary, peripheral chords of the motif section of the selected chord-progression supplied from the block B8 to improve connectivity. By that replacement, the chord-progression of the motif melody MD (M) which replaced the corresponding section-of the selected chord-progression in the block B8 can be connected naturally (smoothly) with the chord-progressions before and after that. The details of the replacement of the peripheral chords are disclosed in Japanese Patent Application 2000-218107. The peripheral chord-replacing block B9 may be omitted if the replacement is not necessary.

A chord-progression displaying block B11 displays the chord-progression on the display 12 in the motif key (detected key), therefore; a second transposing block B10 (FIG. 4) transposes the chord-progression from the specific key CS (S) to the motif key CS (M). The transposing process in the block B10 is executed as the need arises. The transposing process transposes the chord-progression supplied from the block B8 or B9 from the specific key CS (S) to the motif key CS (M) detected in the block B4 by using the interval DK between the detected key and the specific key. The chord-progression in the motif key CS (M) can be displayed on the display 12.

From the chord-replacing block B8 or the peripheral chord-replacing block B9, the chord-progression in the specific key CS (S) the motif section and its peripheral chords of which have been replaced are supplied to a first melody generating block B14 (FIG. 4).

A third transposing block B12 transposing the motif melody MD (M) in the detected key to a motif melody MD (S) in the specific key in accordance with the interval DK detected in the block B5. The motif melody MD (S) in the specific key will be used in the melody generation in the block B12. The transposing process in this block B12 is executed by the similar process as in the Block B7.

A fourth transposing block B13 converts a part of the melody generating parameter PM supplied from the block B3 (e.g., the pitch generating parameter) into a melody generating parameter PM' suitable for the melody generation in the specific key. For example, a register (musical range) is converted in this block B13. The register parameter is converted, before the first melody generating process in the block B14, to a register in the specific key. The first melody-generating block B14 generates a melody in accordance with the register in the specific key. The register parameter will be reconverted into the motif key in a fifth transposing block B15 to be returned to the original register.

The chord-progression CS (S) in the specific key from the block B8 or B9, the motif melody MD (S) transposed into the specific key in the third transposing block B12, and the melody generating parameter PM' a part of which is converted into the specific key in the fourth transposing block B13 are supplied to the first melody generating block B14 (FIG. 4). As a result, the first melody-generating block B14, in accordance with these supplied data, generates melodies for sections other than the motif section. The melodies are generated in the same manner as in the first melody-generating block A 11 in the first embodiments.

The melodies generated in the first melody-generating block B14 are in the specific key; therefore, the next block, a fifth transposing block B15, transposes the melodies into the motif key. For example, when the interval DK (=the specific key−the detected key) is "−7", each tone constituting the melodies is shifted by "−7" (DK) to make them seven semitones below. Also, when the interval DK is considered as "+5", each tone is shifted by "+5". Further, regarding to the above said register parameter; the melodies are generated, in the block B14, within the range of the register converted in the block B13, and the generated melodies are transposed into the motif key. Therefore, the register of the generated melodies is returned to the original register.

Finally, a second melody-generating block B16 generates a complete piece of composition by merging the motif melody MD (M) input in the block B2 and the melodies generated in the block B15.

In this second embodiment, the melody generation in the first melody-generating block B13 is always executed in the same specific key; therefore, the process is very easy. For example, in applying the music rule, only the music rule in the specific key should be considered. Also, only the AVNS in the specific key should be pre-stored or calculated. If the melody generation is executed in the various keys, the AVNS should be prepared in the various keys or be shifted based on the key.

The melody generation process has been described in connection with the first and the second preferred embodiments. The algorism of the melody generation is not limited only to the above preferred embodiments. For example, a user may select whether the chord-progression is transposed into the motif key or not.

The specific key for the chord-progression and the melody generating- parameter is not limited only to C major. Also, a generating melody is not only monophonic but also polyphonic. Further, an accompaniment part may be added to the generated melody, for example, by storing and developing accompaniment style data in accordance with the chord-progression. In this case, a well-known auto accompaniment technique can be used for the addition of the accompaniment.

This invention is embodied not only by an electronic musical instrument or a combination of a personal computer and the software but also by a karaoke system, a game device, a handy communication device such as a mobile phone and an auto-performing piano. When the handy communication device is used, a part of functions may be executed in a server computer to have a server-terminal system.

The embodiment is also applicable to an electronic musical instrument having a tone signal generator, an automatic performance apparatus and the like. The electronic musical instrument may be a keyed instrument type, a stringed instrument type, a wind instrument type, a percussion instrument type, and the like. The embodiment is not limited only to one apparatus, but it may be applied to a system having a plurality of apparatus connected via communication devices such as MIDI and networks.

The MIDI interface may be an RS-232C interface, a USB (universal serial bus) interface, an IEEE1394 interface or the like. Also, data other than MIDI messages may be transmitted/received together with the MIDI data.

The present invention has been described in connection with the preferred embodiments. The invention is not limited only to the above embodiments. It is apparent that various modifications, improvements, combinations, and the like can be made by those skilled in the art.

What are claimed are:

1. An automatic music composing apparatus, comprising:

a memory that stores a plurality of chord-progression data in a specific key;

an input device that inputs motif melody data;

a selector that selects at least one chord-progression data from the memory;

a detector that detects a key of the input motif melody data;

a transposer that transposes the selected chord-progression data into the detected key in accordance with relation between the detected key and the specific key; and a melody data generator that generates a melody in the detected key in accordance with the input motif melody data and the transposed chord-progression data.

2. An automatic music composing apparatus according to claim 1, wherein said melody data generator includes a parameter supplier that supplies melody generating parameters including passage framework, and generates a melody reflecting the motif melody data by copying motif melody for a section including the motif melody or for a section including a variation of the motif melody data.

3. An automatic music composing apparatus according to claim 1, wherein said melody data generator comprises:

a modifier that modifies the chord-progression data by replacing a chord in a motif section of the chord-progression data with a chord of the motif melody data; and a display that displays the modified chord-progression data in the detected key.

4. An automatic music composing apparatus according to claim 1, further comprising a supplier that supplies a melody pitch generating data and wherein the melody data generator generates a melody in the detected key in accordance with the input motif melody data, the transposed chord-progression data and the supplied melody pitch generating data.

5. An automatic music composing apparatus, comprising:

a memory that stores a plurality of chord-progression data in a specific key;

an input device that inputs motif melody data;

a selector that selects at least one chord-progression data from the memory;

a detector that detects a key of the input motif melody data;

a first transposer that transposes the input motif melody data into the specific key in accordance with relation between the detected key and the specific key;

a melody data generator that generates a melody in the specific key in accordance with the transposed motif melody data and the selected chord-progression data; and a second transposer that transposes the generated melody into the detected key.

6. An automatic music composing apparatus according to claim 5, wherein said melody data generator includes a parameter supplier that supplies melody generating parameters including passage framework, and generates a melody reflecting the motif melody data by copying motif melody for a section including the motif melody or for a section including a variation of the motif melody data.

7. An automatic music composing apparatus according to claim 5, wherein said melody data generator includes a parameter supplier that supplies melody generating parameters, transposes part of the melody generating parameters into said specific key, and generates melody using also the transposed melody generating parameter.

8. An automatic music composing apparatus according to claim 5, wherein said melody data generator comprises:

a modifier that modifies the chord-progression data by replacing a chord in a motif section of the chord-progression data with a chord of the motif melody data; and a display that displays the modified chord-progression data in the detected key.

9. An automatic music composing apparatus according to claim 5, further comprising a supplier that supplies a melody pitch generating data and wherein the melody data generator generates a melody in the specific key in accordance with the transposed motif melody data, the selected chord-progression data and the supplied melody pitch generating data.

10. An automatic music composing method, comprising the steps of:

(a) inputting motif melody data;

(b) selecting at least one chord-progression data from a memory storing a plurality of chord-progression data in a specific key;

(c) detecting a key of the input motif melody data;

(d) transposing the selected chord-progression data into the detected key in accordance with relation between the detected key and the specific key; and (e) generating a melody in the detected key in accordance with the input motif melody data and the transposed chord-progression data.

11. An automatic music composing method, comprising the steps of:

(a) inputting motif melody data;

(b) selecting at least one chord-progression data from a memory storing a plurality of chord-progression data in a specific key;

(c) detecting a key of the input motif melody data;

(d) transposing the input motif melody data into the specific key in accordance with relation between the detected key and the specific key;

(e) generating a melody in the specific key in accordance with the transposed motif melody data and the selected chord-progression data; and (f) transposing the generated melody into the detected key.

12. A storage medium storing a program, which a computer executes to realize an automatic music composing process, comprising the method steps of:

(a) inputting motif melody data;

(b) selecting at least one chord-progression data from a memory storing a plurality of chord-progression data in a specific key;

(c) detecting a key of the input motif melody data;

(d) transposing the selected chord-progression data into the detected key in accordance with relation between the detected key and the specific key; and (e) generating a melody in the detected key in accordance with the input motif melody data and the transposed chord-progression data.

13. A storage medium storing a program, which a computer executes to realize an automatic music composing process, comprising instructions for causing the computer to perform the method steps of:

(a) inputting motif melody data;

(b) selecting at least one chord-progression data from a memory storing a plurality of chord-progression data in a specific key;

(c) detecting a key of the input motif melody data;

(d) transposing the input motif melody data into the specific key in accordance with relation between the detected key and the specific key;

(e) generating a melody in the specific key in accordance with the transposed motif melody data and the selected chord-progression data; and (f) transposing the generated melody into the detected key.

* * * * *